United States Patent [19]

Phillips et al.

[11] 4,262,378

[45] Apr. 21, 1981

[54] BUOYANT CAPSULE DEPTH CONTROLLER

[75] Inventors: Charles A. Phillips, Peninsula; John A. Pitrone, Mentor; Edward W. McGraw, Akron, all of Ohio

[73] Assignee: Goodyear Aerospace Corporation, Akron, Ohio

[21] Appl. No.: 46,737

[22] Filed: Jun. 8, 1979

[51] Int. Cl.[3] ..... B63B 21/52

[52] U.S. Cl. ..... 9/8 R; 114/331; 102/14

[58] Field of Search ..... 9/8 R, 8.3 R, 8.3 E, 9/9; 188/295; 102/10, 13, 14; 114/121, 230, 124, 267, 312, 330, 331, 333; 254/158, 160, 185 AB, 186 R

[56] References Cited

U.S. PATENT DOCUMENTS

| | | | |
|---|---|---|---|
| 1,219,530 | 3/1917 | Barnales | 254/158 |
| 3,309,649 | 3/1967 | Ballard | 9/8 R |
| 3,597,778 | 8/1971 | Castelliz | 9/8 R |
| 3,786,403 | 1/1974 | Will | 9/8 R |
| 3,818,524 | 6/1974 | Starkey | 9/8 R |
| 3,991,475 | 1/1976 | Segrest | 9/8 R |
| 4,136,415 | 1/1979 | Blockburger | 9/8 R |

*Primary Examiner*—Trygve M. Blix
*Assistant Examiner*—D. W. Keen
*Attorney, Agent, or Firm*—P. E Milliken; E. W. Oldham; R. L. Weber

[57] ABSTRACT

A buoyant capsule depth controller is presented for positioning and maintaining a capsule within the ocean waters for establishing an observation or defense station. A buoyant capsule is connected to a weight assembly by means of explosive fittings which detonate at a predetermined depth to separate the two. The buoyant capsule and weight assembly are then held together by means of a short line of fixed length until a second predetermined depth is reached, at which time a pressure-actuated release mechanism releases the short line and a cable wound within the weight assembly is payed out to the buoyant capsule below a preset depth as the weight assembly sinks to the ocean floor. The paying out of the cable rotates a shaft within the weight assembly which in turn drives an hydraulic pump, the output of the pump being controlled by a valve to regulate the amount of drag which the pump exerts upon the shaft thus controlling the rate of cable pay out. The valve is controlled by the ambient pressure exerted by the ocean waters, such pressure being indicative of the actual depth of the weight assembly, and the number of rotations of the shaft which is indicative of the actual amount of cable payed out. When the weight assembly sets down on the ocean floor, a locking mechanism is actuated to lock the rotating shaft thus preventing any further cable pay out.

16 Claims, 6 Drawing Figures

1A

1B

1C

1D

1E

BUOYANT CAPSULE DEPTH CONTROLLER

BACKGROUND OF THE INVENTION

Heretofore in the field of underwater surveillance, observation, and warfare, it has been desired to deploy a buoyant capsule into the water and maintain such capsule at a fixed depth therein. With this capsule maintaining observation or warfare equipment, the buoyant capsule may establish a station for surveillance or defense. Various means are available for deploying such a device; a submarine deploying it within the water, a ship deploying it from atop the water, and an aircraft deploying it from above the water. It is most desirable that the same type of device might be utilized regardless of the type of carrier from which it is deployed. It is further desirable that such a device may be deployed in water of unknown depth.

The devices hereinabove referred to are of such nature that the depth at which the buoyant capsule is ultimately maintained is critical. Consequently, with the buoyant capsule and weight assembly being deployed together, the separation between the two must commence at a predetermined level and the rate of separation between the two be effectively controlled to guarantee that when the weight assembly reaches the bottom of the water the buoyant member is maintained at the desired depth. Inherent problems exist with respect to assurances that the member connecting the buoyant capsule to the weight assembly not snap or experience excessive tension therein. Further problems are inherent when electronically controlled devices are utilized in that temperature compensation circuitry becomes necessary to overcome the detrimental effects of decreasing temperature with water depth. Further, the adverse effect that such low temperatures have on battery function and life lessen the reliability and functionability of the system as a whole.

OBJECTS OF THE INVENTION

In light of the foregoing, it is an object of the instant invention to present a buoyant capsule depth controller which is totally mechanical in nature requiring no electronic control circuitry.

Another object of the instant invention is to present a buoyant capsule depth controller wherein an hydraulic pump restraint mechanism is employed to pay out cable between the separating buoyant capsule and weight assembly at such a rate as to circumvent the possibility of excessive tension being experienced by the cable.

Yet a further object of the invention is to present a buoyant capsule depth controller which may be deployed from any of numerous types of carriers.

Still another object of the invention is to present a buoyant capsule depth controller which is relatively simplistic in design, reilable in operation, and conducive to implementation with state-of-the-art elements.

SUMMARY OF THE INVENTION

The foregoing and other objects of the invention which will become apparent as the detailed description proceeds are achieved by a buoyant capsule depth controller for use in water, comprising a capsule, buoyant with respect to water; a weight assembly, non-buoyant with respect to water; a cable maintained by said weight assembly and connected to said capsule; and mechanical means within said weight assembly for paying out said cable to said capsule and for regulating the rate of such paying out as a function of the relationship between the amount of cable actually payed out and the actual depth of the weight assembly within the water.

DESCRIPTION OF THE DRAWINGS

For a complete understanding of the objects, techniques, and structure of the invention reference should be had to the following detailed description and accompanying drawings wherein:

FIG. 6 is the sectional view of FIG. 4 showing the locking mechanism which is actuated when the weight assembly settles at the bottom of the water.

DETAILED DESCRIPTION OF THE PREFERRED EMBODIMENT

Figure 2:
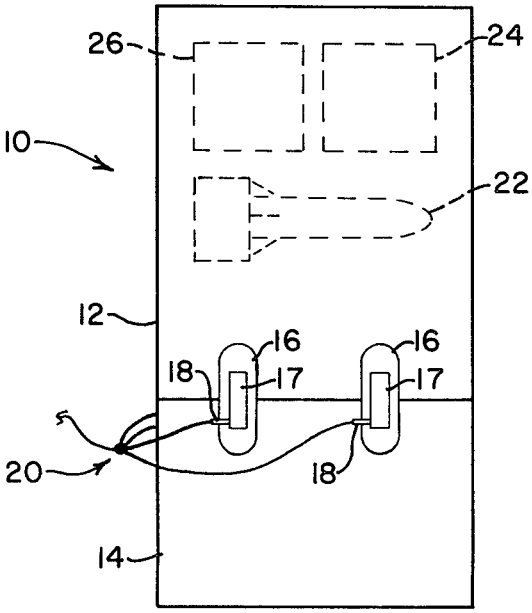
FIG. 2 is a highly schematic plan view of the buoyant capsule controller according to the teachings of the invention.

Referring now to the drawings and more particularly FIG. 2, it can be seen that the invention, in a highly illustrative form, is designated generally by the numeral 10. A buoyant capsule 20 is maintained at a top portion of the assembly 10 and interconnected to a weight assembly 14 by means of bands 16. As will be become apparent hereinafter, the buoyant capsule 12 is of substantially less weight in water than the weight assembly 14, the latter preferably weighing three to four times that of the former. The bands 16 include explosive fittings 17 for achieving separation between the members 12,14. Arming pins 18 are provided for arming the explosive fittings 17 for detonation. An arming harness 20 interconnects each of the pins 18 such that all pins may be withdrawn concurrently. It should, of course, be appreciated that with the buoyant capsule depth controller 10 being of substantially cylindrical nature, there would preferably be a total of four bands 16 associated therewith such that the harness 20 would include four separate cables with each cable being connected to an associated arming pin 18.

The buoyant capsule 12 may be equipped with any of numerous types of devices dependent upon the particular function to be performed thereby. Torpedoes 22 may be provided for launching from a permanent station maintained within the ocean waters, or mines 24 may be included for detonation by intruding watercraft. Yet further, surveillance equipment 26 may be maintained within the buoyant capsule 12 for observing activity within a given range of the station established by the maintenance of the capsule 12 in the ocean waters.

Figure 1:
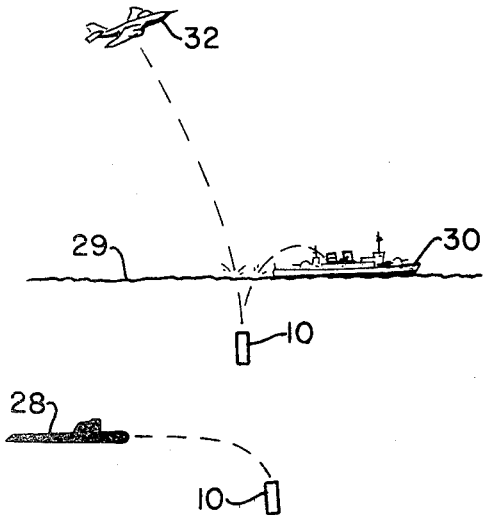
FIG. 1, consisting of FIGS. 1A-1E, is an illustrative showing of the functional operation of the invention to be described.
Figure 1:
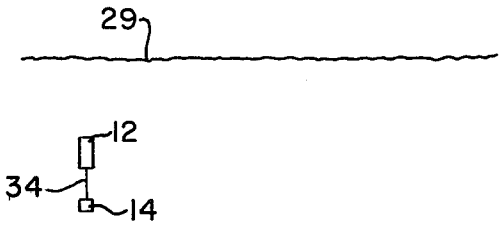
Figure 1:
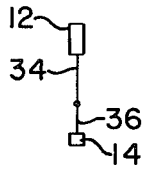
Figure 1:
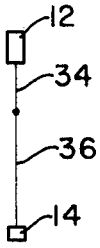
Figure 1:
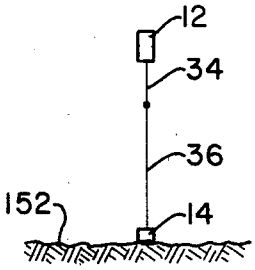

Referring now to FIG. 1, a general understanding of the deployment and operation of the buoyant capsule depth controller 10 may be had. As can be seen in FIG. 1A, the buoyant capsule depth controller 10 may be deployed by means of a submarine 28 under the water 29, from a ship 30 atop the water 29, or from an aircraft 32 thereabove. Once deployed, and with the explosive fittings 17 having been detonated in a manner to be discussed hereinafter, the buoyant capsule 12 and weight assembly 14 are separated and interconnected by a short line 34 of fixed length. The combination 12,14,34 begins to sink into the water 29 until, at a predetermined depth, a cable 36 is released to increase the separation between the buoyant capsule 12 and the weight assembly 14 as in FIG. 1C. The members 12,14 continue to separate and the cable 36 is payed out from the weight assembly 14 as in FIG. 1D until the weight assembly 14 comes to rest upon the ocean floor 152 as shown in FIG. 1E. At this point in time, the cable 36 is secured so that no further pay out may be made and the buoyant capsule 12 remains within the water at the end of the cable 36 at a predetermined depth to establish a defense or observation station thereat. With the cable 36 paying out as in FIGS. 1C and 1D, it should be understood that the buoyant capsule 12 remains substantially stationary in the water; the buoyance of the capsule 12 being counterbalanced by the drag exerted thereon by the descending weight assembly 14 and the rate of pay out of the cable 36.

Figure 3:
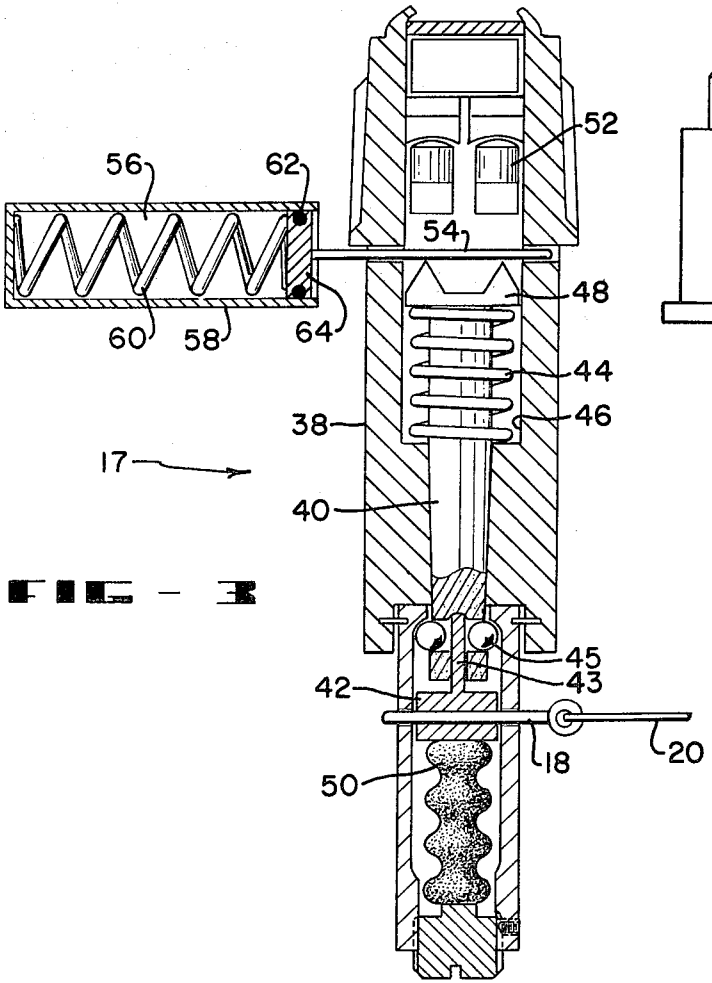
FIG. 3 is a cross-sectional view of the pressure actuated clamp band explosive release fitting for separating the buoyant capsule from the weight assembly.

With a generalized understanding of the operation of the buoyant capsule depth controller 10, reference should now be had to FIG. 3 wherein the explosive fittings 17 are shown in detail. As can be seen, a tubular housing 38 is maintained as part and parcel of the bands 16 interconnecting the buoyant capsule 12 with the weight assembly 14. Maintained within the housing 38 is a piston 14. Maintained within the housing 38 is a piston 40 having a base 42 being slotted to receive therein the arming pins 18 discussed hereinabove. A bellows spring 50 is interposed between an end of the fittings 17 and the base 42 of the piston 40 for reasons which will become apparent hereinafter. A cylinder 46, defined by the housing 38, receives the piston 40 therein with a spring 44 in biased engagement against the piston head 48 urging the same upward as shown in FIG. 3. A set of explosives 52 is also maintained within the cylinder 46 with such explosives being of sufficient charge to destroy the fittings 17 and the band 16 with which it is associated to allow separation of the elements 12,14. The explosives 52 are separated from the piston head 48 by means of a pin 54 in engagement with a pressure actuated spring assembly 58. A spring 60, part and parcel of the spring assembly 58, is in engagement with the head 64 of the pin 54 with the spring normally urging the pin into separating engagement between the piston head 48 and explosives 52. A sealing O-ring 62 is provided as a portion of the head 64 to seal the chamber 56 of the pressure actuated spring assembly 58. The assembly 54-64 is a safety device, assuring a safe separation distance between the deploying station and the assembly 10 before detonation of the explosives 52.

In operation, a buoyant capsule depth controller is deployed from one of the vehicles 28, 30, or 32, discussed hereinabove, and at the time of such deployment the arming pins 18 are withdrawn from the retainers 42 of the associated pistons 40 by means of the harness 20. For deployment by a submarine, the pin 54 is provided as a safeguard restricting the movement of the piston head 48 into contacting engagement with the explosives 52 until the assembly has descended to a depth below that of the submarine. As discussed hereinabove, the chamber 56 is sealed by means of the O-ring 62 such that as the unit 10 descends into the water a pressure differential exists between the interior of the chamber 56 and the ambiance. With the spring assembly 58, chamber 56, spring 60, and head 64 appropriately designed within the capabilities of one skilled in the art, the depth pressure upon the head 64 will become sufficient to create a force great enough to overcome that of the spring 60 and thus withdraw the pin 54 at a predetermined depth; that depth being below the depth of deployment by the submarine and being the controlling factor with respect to the design of the spring 60, the size of the chamber 56, and the size of the piston head 64. In any event, when the buoyant capsule depth controller 10 has reached this predetermined depth, the pin 54 is withdrawn from its safeguard position to allow detonation of the explosives 52 as set forth below.

With continued reference to FIG. 3, it can be seen that the retainers 42 include a pin 43 which partially enters a central portion of the associated piston 40. Balls 45 are maintained within a hollow portion of the piston 40 in separated relationship via the pin 43. The balls 45 abutt an inner portion of the housing 38 and serve as a wedge to restrain the piston 40 against the force of the spring 44. Upon reaching a predetermined depth, the depth pressure collapses the bellows 50, drawing with it the attached retainer 42 and withdrawing the pin 43. The balls 45 then roll into contacting engagement with each other and out of securing engagement with the housing 38; the piston 48 drives upwardly under force of the spring 44 and causes the head 48 to come into detonating engagement with the charge 52. Thus, separation of the buoyant capsule 12 from the weight assembly 14 is achieved.

Figure 4:
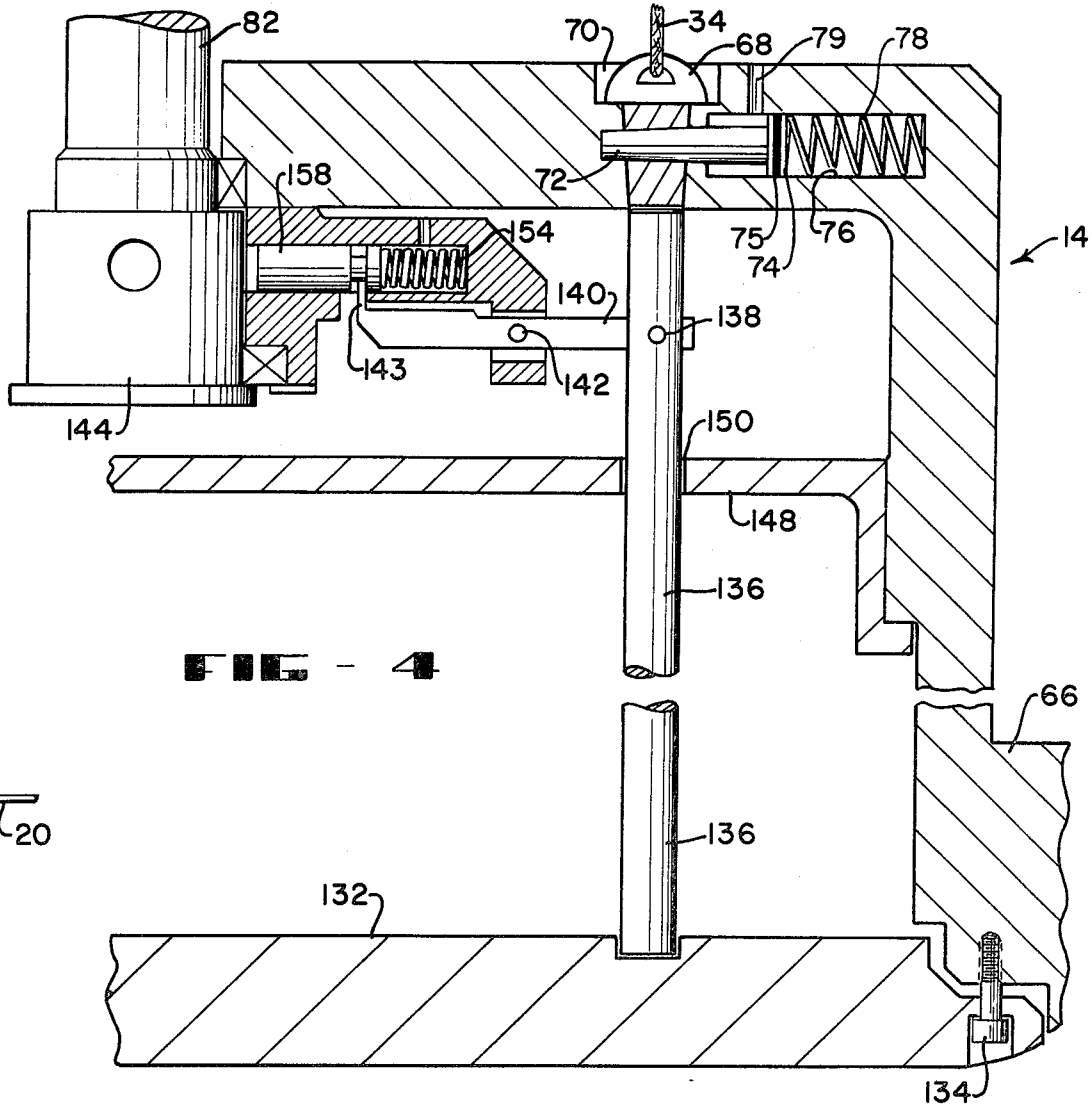
FIG. 4 is a sectional view of a portion of the weight assembly structure showing the short line release mechanism.

As discussed hereinabove with respect to FIG. 1B, upon separation of the elements 12,14, a short line 34 is deployed to hold the two elements together until the assembly has reached a predetermined depth at which time the cable 36 is deployed as in FIG. 1C. With reference now to FIG. 4, it can be seen that the weight assembly 14 includes a casing 66, characterized by the presence of a receptacle 70 therein. Received within the receptacle 70 is an eyelet 68 in securing engagement with a pin 72 passing through the same. The pin 72 is characterized by the presence of a head 74 received within a cavity 76, the head 74 including an O-ring seal 75. The cavity 76 opposite that portion containing the spring 78 is vented to ambience as at 79 such that depth pressure is urged against the head 74. Again, the spring 78, cavity 76, and head 74 are designed such that at a pressure commensurate with a particular depth the head 74 will be urged against the restriction of the spring 78 sufficiently to withdraw the pin 72 from the eyelet 68. It is this eyelet 68 to which the short line 34 is attached. With the pin 72 removed, the eyelet 68 is withdrawn from the receptacle 70 and pay out of the line may begin for further separation of the elements 12,14. A reference to FIG. 6 may be had for a showing of the position of the pin 72 at depths equal to or greater than the predetermined depth at which the short line 34 is released.

Figure 5:
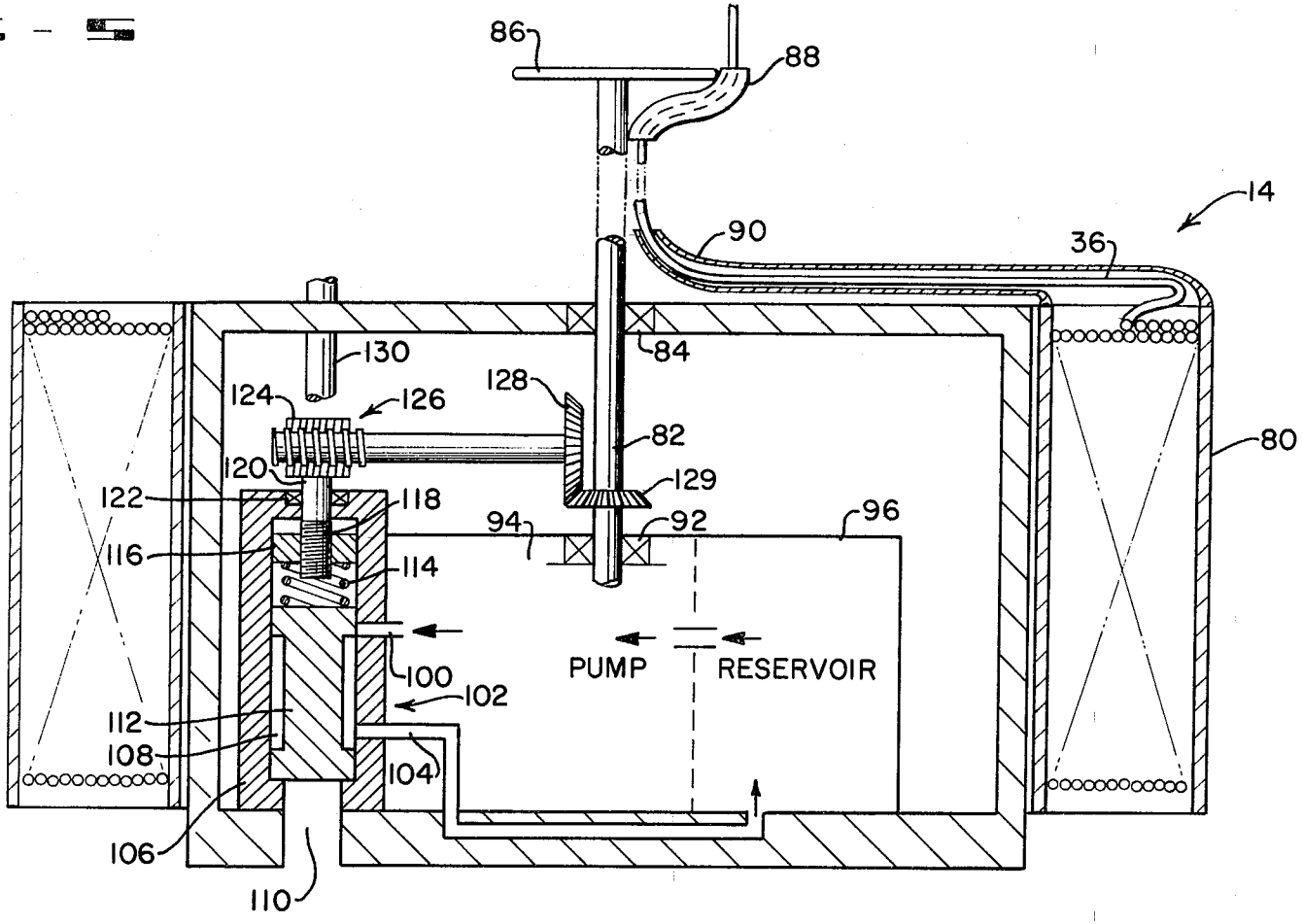
FIG. 5 is a cross-sectional view of the hydraulic pump and control valve utilized in regulating the rate of pay out of the cable interconnecting the buoyant capsule and weight assembly after separation.
Figure 5:
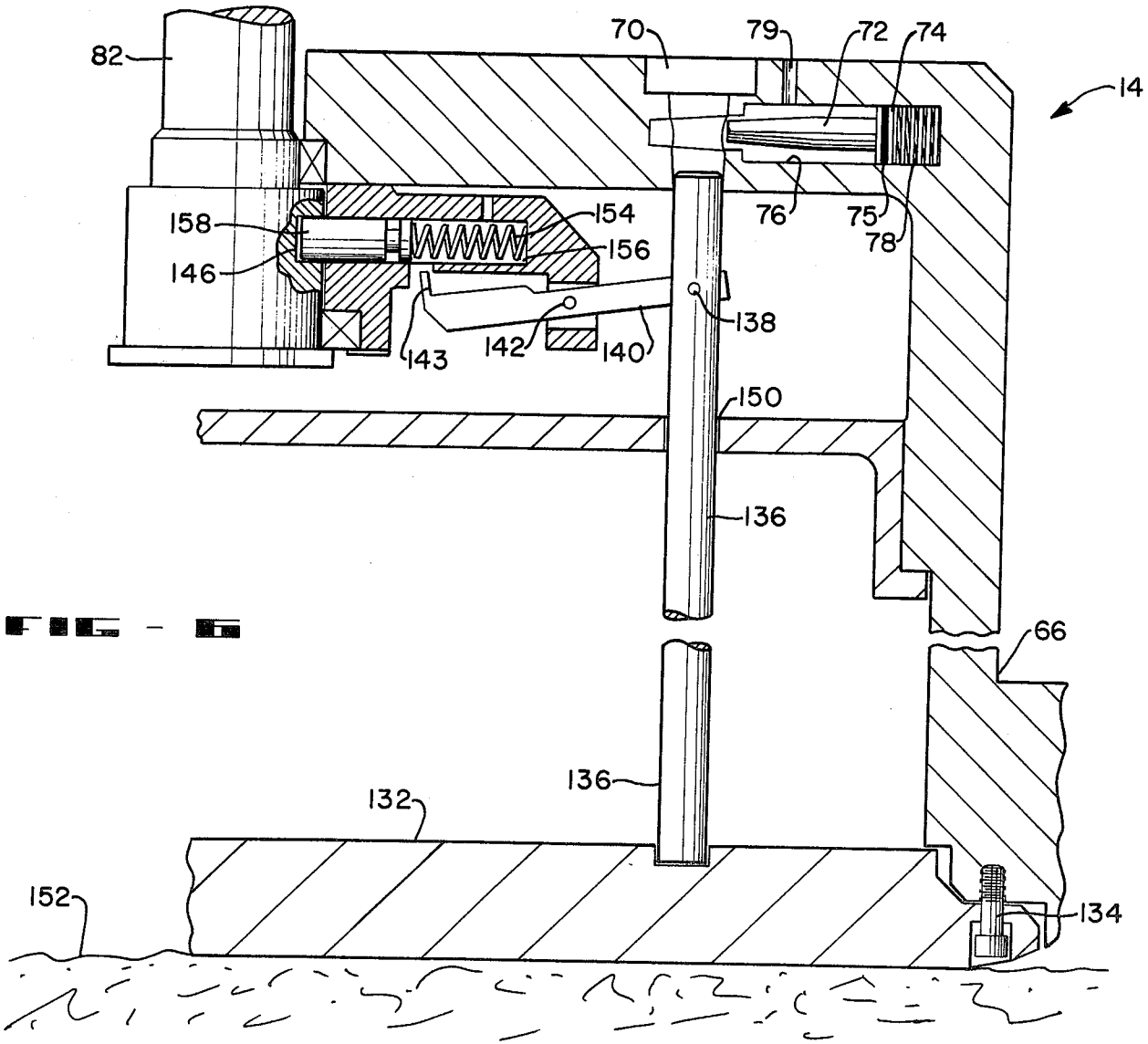

With the short line 34 released, the rate of pay out of the cable 36 interconnecting the elememts 12,14 is regulated by the apparatus shown in FIG. 5. A cable drum 80 is maintained as a portion of the weight assembly 14 and receives therein the cable 36 wrapped thereabout. A shaft 82 is maintained as a portion of the weight assembly 14 within a central portion thereof and is rotatable within a sealing bearing 84. A disk or plate 86 is maintained at the top of the shaft 82 with a curved tube of short length 88 being connected thereto. A tube 90 connected to shaft 82 or other guiding means may be interconnected between the tube 88 and the cable drum 80 to guide the cable 36 from the drum 80, through the tube 88 and upward into engagement with the buoyant capsule 12. As can be seen, as the degree of separation between the elements 12,14 increases, the cable 36 unwinds from the cable drum 80, thus rotating the plate 86 and hence the shaft 82.

The shaft 82 rotates within a bearing and seal 92 with the bottom of the shaft being received within a positive displacement hydraulic pump 94 of standard type; the shaft 82 operating the pump 94. Oil for the pump is maintained within the reservoir 96 and passes, under control of the shaft 82, through the pump 94, a passageway 100, and into the control valve 102. The oil then passes from the control valve 102 through the passageway 104 and back into the reservoir 96. It should be appreciated that if the valve 102 is substantially closed, a tremendous drag is presented against the shaft 82 by means of the pump 94 and hence the rate of pay out of the cable 36 is diminished. It will be understood by those skilled in the art that the hydraulic pump 94 may be a typical recirculating pump which, in reality, acts as a brake to restrict rotation of the shaft 82 and hence payout of the cable 36.

The control valve 102 consists of a casing 106 defining a cavity 108 therein. An opening 110 communicates with the ambient pressure by direct contact with the sea water. A spool 112 is movably maintained within the cavity 108 operating between the pressure exerted thereon at the opening 110 by the depth pressure and at the other end by means of a spring 114. The spring 114 is urged against the spool 112 by means of a piston 116 which is threadedly engaged at 118 to a gear shaft 120 rotatable within the seal and bearing 122. The shaft 120 is interconnected to a gear 124 which in turn engages gear 126. Affixed to and rotatable with the shaft 82 is a gear 129 which in turn rotates gear 128. The gears 124, 126, and 128 comprise a gear reducer such that, in the preferred embodiment, one inch of travel of the threaded shaft 120 is equivalent to 1,000 revolutions of the plate 86; which number of revolutions is equivalent to a known amount of cable 36 payed out. This one inch per 1,000 revolutions relationship is converted to a force by means of the spring 114. The spring compression force on the topside of the hydraulic spool 112 thus represents a change in depth of the weight assembly 14.

The spring compression force on the topside of the hydraulic spool 112 imparted by the spring 114 is compared with the force representing the actual depth of the assembly 14 as determined by the ambient sea water pressure exerted on the spool 112 through the opening 110. If the error between these two forces is zero, the spool position is unchanged and hence the drag imparted by the pump 94 to the rotation of the shaft 82 remains constant. If should, of course, be appreciated that the force or torque applied to the shaft 82 to drive the pump 92 is created by the tension in the cable 36 operating on the pay out arm or disc 96. If the force error, as sensed by the spool 112, is such that the actual depth is greater than the amount of cable payed out, the valve spool 112 moves in such a direction as to decrease the drag on the cable 36 by better opening the passageways 100,104 until the force error is reduced to zero. If the force error is such that the actual depth is less than the amount of cable payed out then the force error causes the spool 112 to close over the passageway 100 to increase the drag on the pump 94, shaft 82, and consequently the cable 36, so that the velocity of the weight decreases until the force error returns to zero.

It should thus be appreciated that the rate of descent of the weight assembly 14 hunts about a zero force error such that the amount of cable payed out and the actual depth of the weight assembly 14 correspond, thus indicating that the proper degree of separation has been achieved between the buoyant capsule 12 and the weight assembly 14.

The design of the control valve 102 (the size of the spool 112, the nature of the spring constant of the spring 114, the size of the cavity 108, and the size and positions of the passageways 100,104) must, of course, be made with due respect to the interrelationships of each of the parenthetically noted parameters. Further, the design must be made with due consideration given to the depth at which the buoyant capsule 12 is ultimately to rest and the depth of the ocean at such point. Such parameters thus determine the point at which the short line 34 is released, the present force on spring 114, and the rate of pay out of the cable 36. All of these considerations are believed to be well within the capability of one skilled in this art.

An adjustment rod 130 may be provided in interconnection with the control valve 102 for calibrating the same by adjusting the initial compression of the spring 114.

Once the weight assembly 14 has touched down upon the ocean floor it is, of course, desirable that no further pay out of the cable be experienced. A mechanism has been provided for such purposes and reference to FIGS. 4 and 6 should be made for an appreciation of the same. As can be seen, the weight assembly 14 includes a base portion 132 which is interconnected by means of a bolt 134 to the side casing 66. It is well to note that the bolt 134 is threaded only into the casing 66 with the base 132 being vertically movable thereon. A rod 136 rests upon or is received within a recess in the base 132 and passes vertically upward therefrom and through a hole 150 within a horizontal support member 148. A pivot pin 138 protrudes from the rod 136 and pivotally maintains thereon an end of a lever arm 140. The lever arm 140 is further connected to a second pivot pin 142. In the descending posture shown in FIG. 4, the lever arm 140 is in a substantially horizontal position with the end 143 of the lever arm 140 being in restrictive engagement with a piston 158. The piston 158 is secured by the end 143 against the biasing of a spring 154 maintained within a cavity 156. However, when the weight assembly 14 touches down upon the ocean floor 152 as shown in FIG. 6, the casing 66 settles down upon the base 132 and the rod 136 is thereby pushed downwardly such that the lever arm 140 pivots about the pin 142 with the end 143 thus being released from the piston 158. The spring 154 thus urges the piston 158 into engagement with a slot 146 within the hub 144 of the shaft 82. The engagement of the piston within this slot inhibits any further rotation of the shaft 82 inasmuch as the hub is in rotational engagement therewith. Consequently, no further pay out of the cable 36 may be experienced and the buoyant capsule 12 is maintained at a fixed station above the weight assembly 14.

Thus it can be seen that the objects of the invention have been achieved by the structure presented hereinabove. While in accordance with the patent statutes only the best mode and preferred embodiment of the invention has been presented and described in detail, it is to be understood that the invention is not limited thereto or thereby. Consequently for an appreciation of the true scope and breadth of the invention, reference should be had to the following claims.

What is claimed is:

1. A buoyant capsule depth controller for use in water, comprising:

a capsule, buoyant with respect to water;

a weight assembly, non-buoyant with respect to water;

a cable maintained by said weight assembly and connected to said capsule;

a rotatable shaft in operative connection with said cable, the paying out of said cable rotating said shaft;

a pump connected to and driven by said rotatable shaft, a reservoir maintaining fluid for pumping by said pump, a fluid passageway interconnecting said pump and said reservoir and a valve interconnected within said fluid passageway for selectively restricting the flow of said fluid through said pump; and wherein said valve includes a spool movably maintained within a chamber, the first end of said spool being exposed to ambient pressure urging said spool in a first direction, and a second end of said spool in contacting engagement with mechanical adjustment means connected to and controlled by said rotatable shaft for urging said spool in a second direction.

2. The buoyant capsule depth controller as recited in claim 1 wherein said mechanical adjustment means comprises:

a spring in contacting engagement with said second end of said spool;

a piston in contacting engagement with said spring;

a shaft threadedly connected to said piston; and a first gear connected to and driving said shaft.

3. The buoyant capsule depth controller as recited in claim 2 wherein said mechanical adjustment means further includes a second gear connected to and rotatable with said rotatable shaft and a gear reducer interconnecting said first and second gears.

4. The buoyant capsule depth controller as recited in claim 1 which further includes a plate mounted to and rotatable with said rotatable shaft, said cable passing across an edge of said plate.

5. The buoyant capsule depth controller as recited in claim 1 which further includes a piston in juxtaposition to said rotatable shaft, said piston being biased toward said shaft by a spring and in engagement with a release lever.

6. The buoyant capsule depth controller as recited in claim 5 wherein said weight assembly has a base attached to a side portion thereof, said base being connected to said side portion and movable with respect thereto, and which further includes a rod connected to said release lever and in contacting engagement with said base.

7. The buoyant capsule depth controller as recited in claim 1 wherein said capsule and weight assembly are interconnected by a line of fixed length.

8. The buoyant capsule depth controller as recited in claim 7 wherein said line is connected at one end to a release mechanism for releasing said line at said one end, said release mechanism comprising:

a first pin to which said one end of said line is secured;

a second pin in securing engagement with said first pin; and pressure actuated retraction means connected to said second pin for releasing said second pin from its securing engagement with said first pin at a predetermined depth within the water.

9. A buoyant capsule depth controller for use in water, comprising:

a capsule, buoyant with respect to water;

a weight assembly, non-buoyant with respect to water, connected to said capsule by a line of fixed length and further connected thereby by a plurality of pressure actuated release members;

a cable maintained about the weight assembly and connected to said capsule;

a rotatable shaft within said weight assembly and in communication with said cable, such shaft being rotated by said cable being payed out from said weight assembly to said capsule;

an hydraulic pump connected to and driven by said shaft;

a pressure responsive valve interconnected between said pump and said shaft and regulating the rate of pay-out of cable from said weight assembly to said capsule, said valve comprising:

a spool movably maintained within a chamber and having a first end thereof in contact with the water;

a piston adjustably maintained within the chamber;

a spring interposed between said piston and a second end of said spool, the ambient pressure of the water urging the spool in a first direction and said spring urging said spool in a second direction.

10. The buoyant capsule depth controller as recited in claim 9 wherein said weight assembly includes a casing having a chamber therein and further including:

a securing means connected to and securing said line to said weight assembly; and a pin received within and sealing said chamber, said pin being in pressure actuated retractable engagement with said securing means.

11. The buoyant capsule depth controller as recited in claim 9 wherein said pressure actuated release members each comprise:

an explosive charge;

a spring-biased plunger opposite said charge; and a pin retractably interposed between said plunger and said charge and in restrictive contacting engagement with said plunger, said plunger being pressure actuated.

12. The buoyant capsule depth controller as recited in claim 9 wherein said piston is operatively connected to said rotatably shaft, said piston moving against said spring at a predetermined rate dependent upon the rate of rotation of said rotatable shaft.

13. The buoyant capsule depth controller as recited in claim 9 wherein said weight assembly includes a side casing having a bottom casing attached thereto, said bottom casing being restrictably movable with respect to said side casing.

14. The buoyant capsule depth controller as recited in claim 13 which further includes:

a spring-biased piston in juxtaposition to said shaft;

a lever arm having one end thereof in releaseable contacting engagement with said piston; and a rod in contacting engagement with said bottom casing and movable therewith, said rod being connected to a second end of said lever arm, movement of said rod with said bottom casing releasing said one end of said lever arm from said piston.

15. The buoyant capsule depth controller as recited in claim 14 wherein said rotatable shaft is characterized by the presence of a slot therein, said slot being in periodic alignment with a longitudinal axis of said piston.

16. A buoyant capsule depth controller for use in water, comprising:

a capsule, buoyant with respect to water;

a weight assembly, non-buoyant with respect to water;

a cable maintained by said weight assembly and connected to said capsule;

mechanical means within said weight assembly for paying out said cable to said capsule and for regulating the rate of such paying out as a function of the relationship between the amount of cable actually payed out and the actual depth of the weight assembly within the water; and wherein said capsule and weight assembly are interconnected by explosive fittings, comprising:

an explosive charge;

a spring biased plunger;

a pin interposed between and separating said plunger and said explosive charge; and pressure actuated pin retraction means connected to said pin for removing said pin from its interposed position at a predetermined depth within the water and said pressure actuated pin retraction means comprising a sealed chamber having a spring therein, said pin having a head thereon received within said chamber and biased into its interposed position by said spring.

* * * * *